US005545371A

United States Patent [19]

Lu

[11] Patent Number: 5,545,371

[45] Date of Patent: Aug. 13, 1996

[54] PROCESS FOR PRODUCING NON-WOVEN WEBS

[75] Inventor: Fumin Lu, Tamarac, Fla.

[73] Assignee: Ason Engineering, Inc., Fort Lauderdale, Fla.

[21] Appl. No.: 356,738

[22] Filed: Dec. 15, 1994

[51] Int. Cl.[6] ..... D01D 5/12; D04H 3/03

[52] U.S. Cl. ..... 264/555; 264/103; 264/210.8; 264/211.14

[58] Field of Search ..... 264/103, 210.8, 264/211.14, 555

[56] References Cited

U.S. PATENT DOCUMENTS

| | | | |
|---|---|---|---|
| 3,802,817 | 4/1974 | Matsuki et al. | 425/66 |
| 4,064,605 | 12/1977 | Akiyama et al. | 28/100 |
| 5,045,271 | 9/1991 | Mente et al. | 264/555 |
| 5,292,239 | 3/1994 | Zeldin et al. | 425/66 |

FOREIGN PATENT DOCUMENTS 230541 8/1987 European Pat. Off. .

*Primary Examiner*—Leo B. Tentoni

*Attorney, Agent, or Firm*—Malin, Haley, DiMaggio & Crosby

[57] ABSTRACT

An apparatus, process and product by process for producing a non-woven polymeric fabric web, such as a spunbond web, having filaments of 0.1 to 3.0 denier with equivalent production rates. The apparatus includes a polymer filament extruder and a melt spinning device with a spinneret having multiple spaced orifices for extruding a plurality of continuous polymeric filaments, a drawing unit that includes a longitudinal elongated slot strategically positioned at a predetermined distance below the spinneret to produce the desired filament diameter, a nozzle for providing an air supply strategically within a drawing unit slot for creating turbulence, and a web forming unit positioned below the slot for collecting the filaments and forming the filaments into a non-woven fabric web. The apparatus may also include a water spray unit positioned adjacent to and surrounding the spinneret for cooling the filaments to prevent premature sticking together of the filaments and enhancing the production rate. The product produced herein is useful in medical and personal hygiene products and filtration materials, including diaper covers, liquid vapor barriers which are breathable and have air permeability.

3 Claims, 3 Drawing Sheets

PROCESS FOR PRODUCING NON-WOVEN WEBS

BACKGROUND OF THE INVENTION

1. Field of the Invention

This invention relates generally to an apparatus, process, and the product produced therefrom for constructing a spunbond, non-woven web from thermoplastic polymers producing filaments of reduced diameter and improved uniformity at an increased production rate, and specifically, to an apparatus, process, and product for heating and extruding thermoplastic materials through a spinneret, forming filaments of finer deniers by strategically positioning the drawing unit below the spinneret at a critical distance to produce a finer filament of a desired diameter and with an improved production rate. A water spray for cooling is also employed.

2. Description of the Prior Art

Devices for producing non-woven thermoplastic fabric webs from extruded polymers through a spinneret that form a vertically oriented curtain with downward advancing filaments and air quenching the filaments in conjunction with a suction-type drawing or attenuating air slot are well known in the art. U.S. Pat. No. 5,292,239 discloses a device that reduces significant turbulence in the air flow to uniformly and consistently apply the drawing force to the filaments, which results in a uniform and predictable draw of the filaments. U.S. Pat. Nos. 3,802,817 and 4,064,605 and European Patent Application No. 0230541 disclose examples of the formation of non-woven fabrics.

Conventionally, thermoplastic polymers such as polypropylene, polyethylene, polyester, nylon, and blends thereof are utilized. In the first step, the polymer is melted and extruded through a spinneret to form the vertically oriented curtain of downwardly advancing filaments. The filaments are air quenched for cooling purposes. A drawing unit which acts as a suction having an air slot where compressed air is introduced into the slot, drawing air into the upper open end of the slots forms a rapidly moving downstream of air in the slot. This air stream creates a drawing force on the filaments, causing them to be attenuated or stretched and exit the bottom of the slot where they are deposited on a moving conveyor belt to form a continuous web of the filaments. The filaments of the web are then joined to each other through conventional techniques.

Providing for conventional construction of the filaments, typically filaments of 1.5 to 6 deniers or higher were produced. Using conventional methods, the hot filaments leaving the spinneret typically were immediately cooled to ambient temperature and solidified and then subjected to the drawing unit. Although the conventional method and apparatus produce suitable non-woven webs, the final product could be greatly improved and better fabric can be produced consisting of lower denier filaments. A thinner filament produces more surface area and more length per unit weight. A polypropylene spunbonded fabric with filaments of 0.1 to 2.0 deniers would be desirable. When evaluating the thickness, different types of thermoplastic polymers may require some adjustment in thickness. Slightly varying diameters in other thermoplastic polymers such as polyethylene or polyester may require an adjustment also to consider the production rate.

It is also desirable that a uniformity of denier and tensile properties be consistent so that the resulting fabric web has a uniform quality.

Examples of end uses for the fabric web could be filtration materials, diaper covers and medical and personal hygiene products requiring liquid vapor barriers that are breathable and have air permeability.

With the present invention, an apparatus and process for producing a superior filament useful as a spunbonded non-woven fabric can be achieved having near or close to optimum filament denier with improved production rates. Using the present invention, the Applicant produces filaments of the desired thickness and tensile strength, resulting in a non-woven web of improved quality. The invention is achieved by changing the position of the drawing unit from conventional distances of 3 meters or more between tile spinneret and the drawing unit to substantially around 0.2–0.5 meters. The increase in drawing force and a decrease in distance of the drawing unit to the spinneret greatly affects the drawing and enhances the thinness of the filaments. By changing the position of the drawing unit and utilizing a water mist, tile diameter of the filaments can be controlled in such a way that while sticking among filaments in contact can be avoided, the temperature of the filaments remains as high as possible before they enter the drawing unit, reducing the viscosity of the filaments being drawn and consequently facilitating the attenuation of the filaments, resulting in filaments having much smaller diameters. In addition, the invention provides an intensive "flapping" or "waving" pattern of the filaments' movement by a turbulent air flow of the air stream coming out of the nozzle so that form drag rather than pure viscous drag is fully utilized. This drag significantly increases the air drag force and leads to smaller filaments being produced. The position of the web forming table corresponding to the drawing unit can also be adjusted in order to form a non-woven web which has desired uniformity with other mechanical properties.

A water mist can be added for interacting in the process to improve the filament uniformity and production. The water mist improves the process, but the basic apparatus and process will work without the water mist solely by reduced the separation of the spinneret and the drawing unit.

SUMMARY OF THE INVENTION

A process and apparatus for producing a spunbond, non-woven web composed of filaments of reduced diameter and improved uniformity from thermoplastic materials at an increased production rate, comprising a melt spinning device having an extruder for heating and extruding thermoplastic materials through a spinneret, forming substantially a plurality of vertically oriented polymeric filaments and a filament drawing unit having a longitudinal elongated slot substantially equal in length to the spinneret, said drawing unit being strategically positioned below the spinneret at a critical distance to receive the filaments therein. The distance between the elongated slot of the drawing unit and the spinneret is critically determined to provide a proper finer filament of a desired diameter, resulting in a better sized filament in diameter and an improved production rate. The important distance between the elongated slot in the drawing unit and the base of the spinneret where the plastic materials are extruded is substantially around 0.2–0.5 meters. By positioning the drawing unit relatively close to the base of the spinneret, a finer denier filament is obtained because the drawing process happens as the hot molten threads exit the spinneret, which allow them to be cooled enough not to stick together while simultaneously being hot (soft) enough to be drawn into a finer, more uniform denier filament. In conventional devices where there is a large space between the base of the spinneret and the drawing unit, typically the hot molten threads are first cooled to ambient temperature and solidified and then reach the drawing unit where it more difficult to achieve the type of finer or thinner filaments that are obtained from the present invention. The filaments, when hot, can be stretched or attenuated to a finer diameter using the present invention. The result is a better product because it has surface area and more length per unit weight and higher strength.

The drawing unit has a V-shaped slot along the upper portion with a horizontally directed elongated open end at the top and opposing side walls that depend from the open top end, towards each other, to form a narrow gap at the end of the upper portion of the slot. An adjacent nozzle that supplies a directed stream of air introduced into the slot along the entire length of the slot so that a turbulent flow pattern is formed in the area where two directed air streams merge with each other. The slot also includes a bottom portion that is shaped to improve randomness of the spreading of filaments for uniformity of the resultant web.

A web forming table is positioned below the drawing unit to receive the sheet of filaments, forming the same into a non-woven web.

The apparatus is constructed such that the position and location of the drawing unit and the web forming table can each be independently adjusted vertically along the spin line, as well as horizontally perpendicular to the spin line.

Two independent sets of multiple water spray nozzles are installed for atomizing the water supply for the air supply. The first set of water spray nozzles is installed inside the air chamber of the drawing unit. The second set of water spray nozzles is positioned between the spinneret and the drawing unit. Mist produced from the spray head serves to cool down the air and the filaments so as to prevent filaments from sticking to each other if and when in contact before the filaments enter the drawing unit. It is also believed the mixture of air with moisture has a higher density which will increase the air drag force correspondingly. The apparatus includes two air supply nozzles communicating with the drawing slot on both sides to form an angle of 15° to 30° each, each adapted to a curved air passageway for introducing a directed stream of air. A turbulent flow pattern is created when air streams exiting from both nozzles come together in contact with the filaments as well as each other so that an intensive "flapping" or "waving" motion of the filaments is established. This interaction of the air and filaments drastically increases the air drag force exerted on the filaments, resulting in increased attenuation of the filaments.

In order to operate the device, at startup, the drawing unit is positioned away from the spinneret and the polymer throughput and the air speed is nominal in order to make threading of the spin line easy and effective. Once threading is completed and the spin line stabilized, the drawing unit can then be raised gradually towards the spinneret and the polymer through put and the air speed is appropriately increased until a position between the spinneret and drawing unit is reached to produce the finest filament and best uniform web at the equivalent production rate. The web forming table in relation to the air drawing unit should also be accordingly adjusted for desired web property, such as web uniformity and loftiness.

It is an object of this invention to produce a spunbond, non-woven web comprised of filaments having a smaller diameter than conventionally produced filaments with a better uniformity from thermoplastic materials at a higher production rate.

It is another object of this invention to produce a spunbond, non-woven web comprised of thermoplastic filaments having an optimum small denier for creating filaments with more surface area and more length per unit weight for use as a non-woven web.

And yet still another object of this invention is to provide a method for producing finer filaments with better uniformity from thermoplastic materials for use as spunbond, non-woven webs at a higher production rate.

In accordance with these and other objects which will become apparent hereinafter, the instant invention will now be described with particular reference to the accompanying drawings.

DESCRIPTION OF THE PREFERRED EMBODIMENTS

Figure 1:
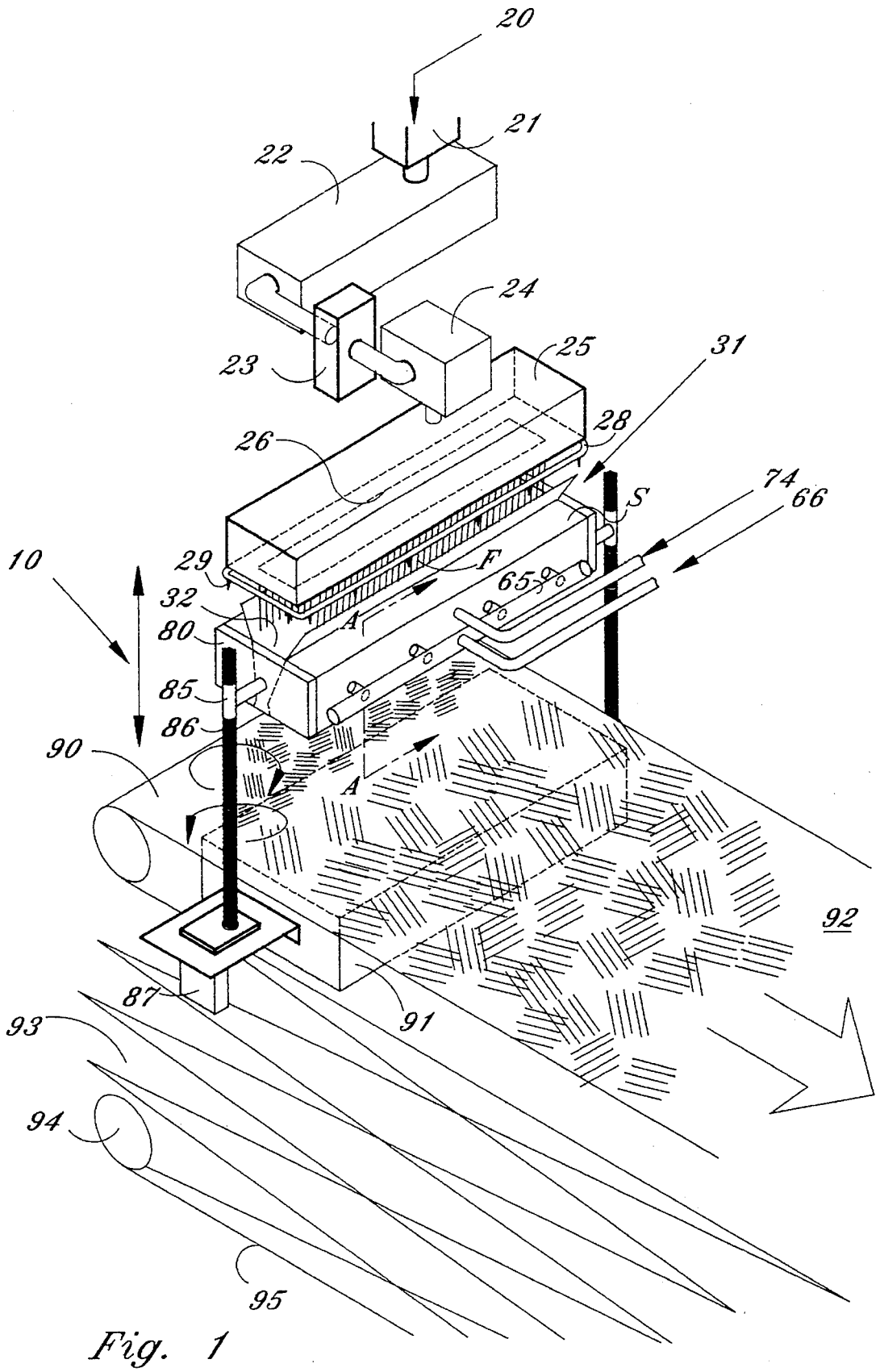
FIG. 1 shows a perspective view of the apparatus in accordance with the present invention.

Referring now to the drawings and in particular FIG. 1, the present invention is shown generally at 10 that includes a conventional melt spinning machine that includes an extruder 22, spinbeam 25, and the drawing unit 31.

The drawing unit 31 is movably supported above a movable mesh wire belt conveyor 92 that is a component of the web forming table 90. The web forming table further comprises an adjustable (vertically) base 93 which can be used to adjust vertically the distance between the top of the table 90 and the spinneret 26 in a range of about 30 to 150 cm. Wheels 94 under the base 93 are mounted on a pair of tracks 95 so that the web forming table 90 can be moved back and forth horizontally to allow certain space for changing of the spinneret 26.

Polymer is fed from polymer supply 20 into hopper 21 where the polymer is heated and melted in extruder 22, pushed through filter 23 and metering pump 24 to spin beam 25, where it is then extruded through a spinneret 26 having a plurality of multi-rowed orifices, together forming a curtain of vertically downwardly advancing filaments F.

The invention 10 further includes and comprises a water spray unit 28 positioned from 0 to 20 cm below the spinneret which includes a water pipe adjacent to and surrounding the spinneret with a number of spray heads 29, downwardly installed and 10 to 25 cm laterally apart from each other.

The drawing unit 31, which acts to attenuate the filaments, includes an elongated longitudinal slot 32 which is strategically aligned below the spinneret to receive the curtain of filaments. The most important distance, however, is the distance between the base of spinneret 26 and the top of the drawing unit 31. The filaments F, before being sucked in and drawn by the drawing unit 31, are cooled and partially solidified by a fast moving stream of mixture of air and atomized water entrained by the suction of the drawing unit 31 of ambient air with mist produced by the water spray unit 28.

Figure 2:
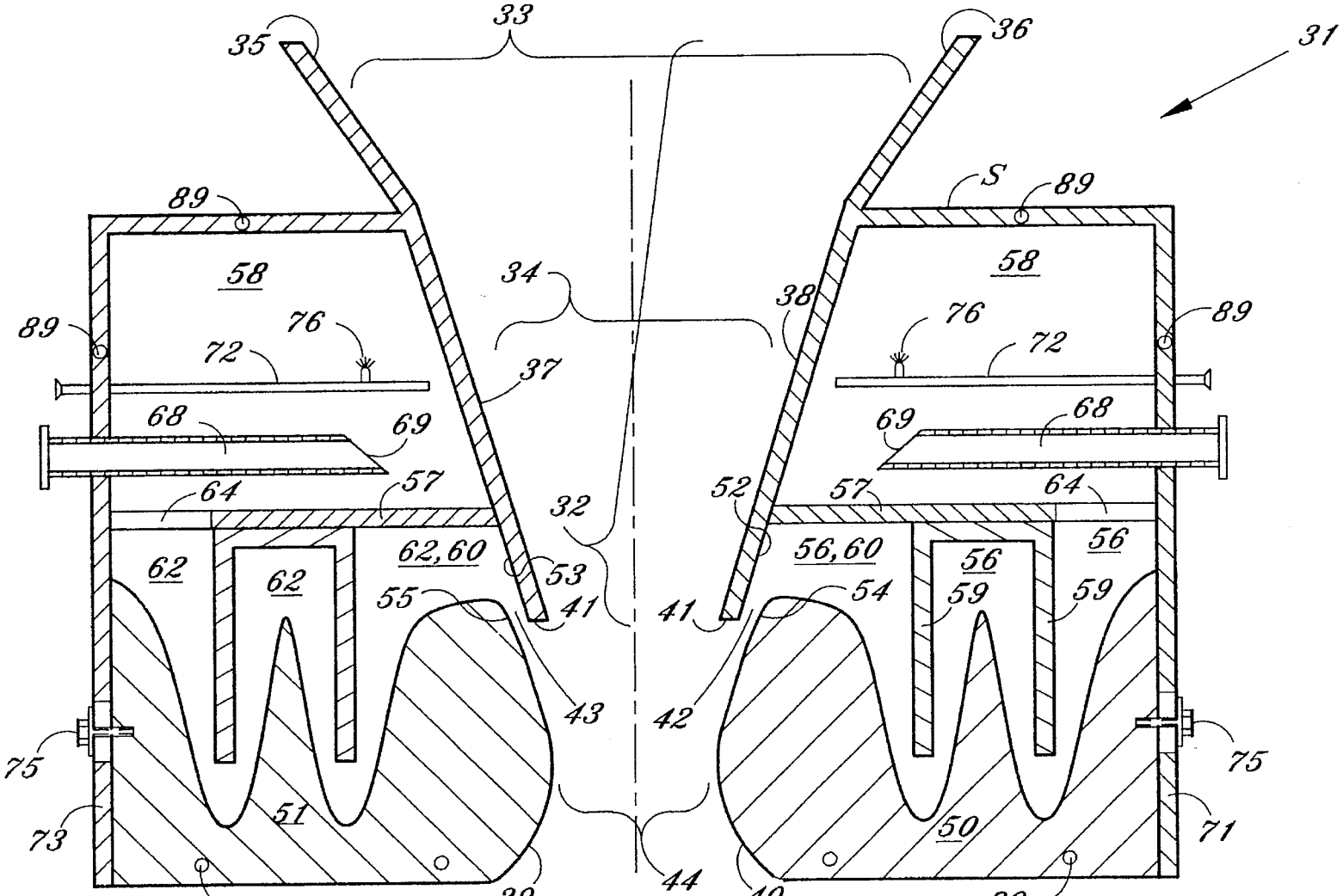
FIG. 2 shows a side elevational view of the drawing unit in cross section used in the present invention.

Referring now to FIG. 2, the drawing unit 31 includes slot 32 having a horizontally directed, elongated open top slot segment 33 that includes a pair of side walls 35 and 36 projecting from upper surface S of the drawing unit 31 at an angle of up to 90°. The drawing unit 31 also includes upper slot segment 34 comprised of a pair of side walls 37 and 38 which depend from the top slot segment 33 at an angle of substantially between 15° to 60° and preferably, 30° to 45°. The slot 32 further comprises a lower slot segment 44 having lower side walls of a pair of bottom blocks 50 and 51. Transverse shoulders 41 are positioned between the upper and lower slot segments 34 and 44 on each side of the slot 32. A pair of air nozzles 42 and 43 on each side of slot 32 extend along the entire longitudinal length of the slot 32 and are formed between inner surfaces of the lower end of the upper slot side walls 37 and 38 and the opposing surfaces 54 and 55 of bottom blocks 50 and 51.

An air passageway 56 extends along the entire longitudinal length of the slot 32 of drawing unit 31 and is defined by separation plate 57 at the bottom of air chamber 58, having two vertically sectional plates 59 attached, and a curved surface of bottom blocks 50 and 51. The air passageway 56 is divided into two segments, a discharge segment 60 connected with nozzles 42 and 43 having a gradually smoothly reducing width in the direction towards the associated nozzle and a unifying segment 62 that contains four parallel vertical sections in an arcuately curved section between each pair of vertical sections. The unifying segment of the air passageway 62 is connected with the air chamber 58 through an air window 64 which is a brake plate placed at the edge of the separation plate 57 adjacent to side walls 70 and 71 of the drawing unit 31.

Air is fed to air chamber 58 through a manifold 65 connected to a suitable air supply unit 66 (see FIG. 1). The air chamber 58 comprises a number of air lines 68 coming into air chamber 58 from manifold 65 and having an open end 69 facing up and close to side walls 37 and 38 of the upper slot segment. The arcuately curved section of the air passageway in unifying segment creates an air pressure drop which serves to equalize the air volume flow rate and velocity along the entire longitudinal length of the slot 32, especially at the outlet of the nozzles 42 and 43. The area for the passage of air decreases gradually along the air passageway from air window 64, all the way to the outlet of the nozzles 42 and 43, which also serve to unify the air pressure. As a result, the air flow at the outlet of the nozzles 42 and 43 will be uniform in volume and velocity along the entire longitudinal length of slot 32.

The air chamber 58 further includes a number of water spray heads 76 installed and in fluid communication with water inlet pipe 72 connected to a water supply unit 74. The mist from the water spray heads serves to cool down the incoming air from the air supply unit 66, which facilitates the solidification of filaments contacting the air stream.

The bottom blocks 50 and 51 of the drawing unit are constructed in such a way that the upper surfaces of the blocks, which define the air passageway with the separation plates 57 and two vertical sectional plates 59, are composed of two downwardly arcuately curved and one upwardly arcuately curved edge. The two downwardly curved edges have different depths. The edge closer to the air window 64 is 2 to 10 mm longer than the other edge. The bottom blocks 50 and 51 of the drawing unit are connected with side walls 73 and 71 of the drawing unit by a plurality of bolts 75 through extended holes on the upside walls 71 and 73 so that the positions of the blocks can be adjusted up or down to change the gap of the nozzles 42 and 43 and therefore the volume and velocity of air flow according to the needs of the process.

Figure 3:
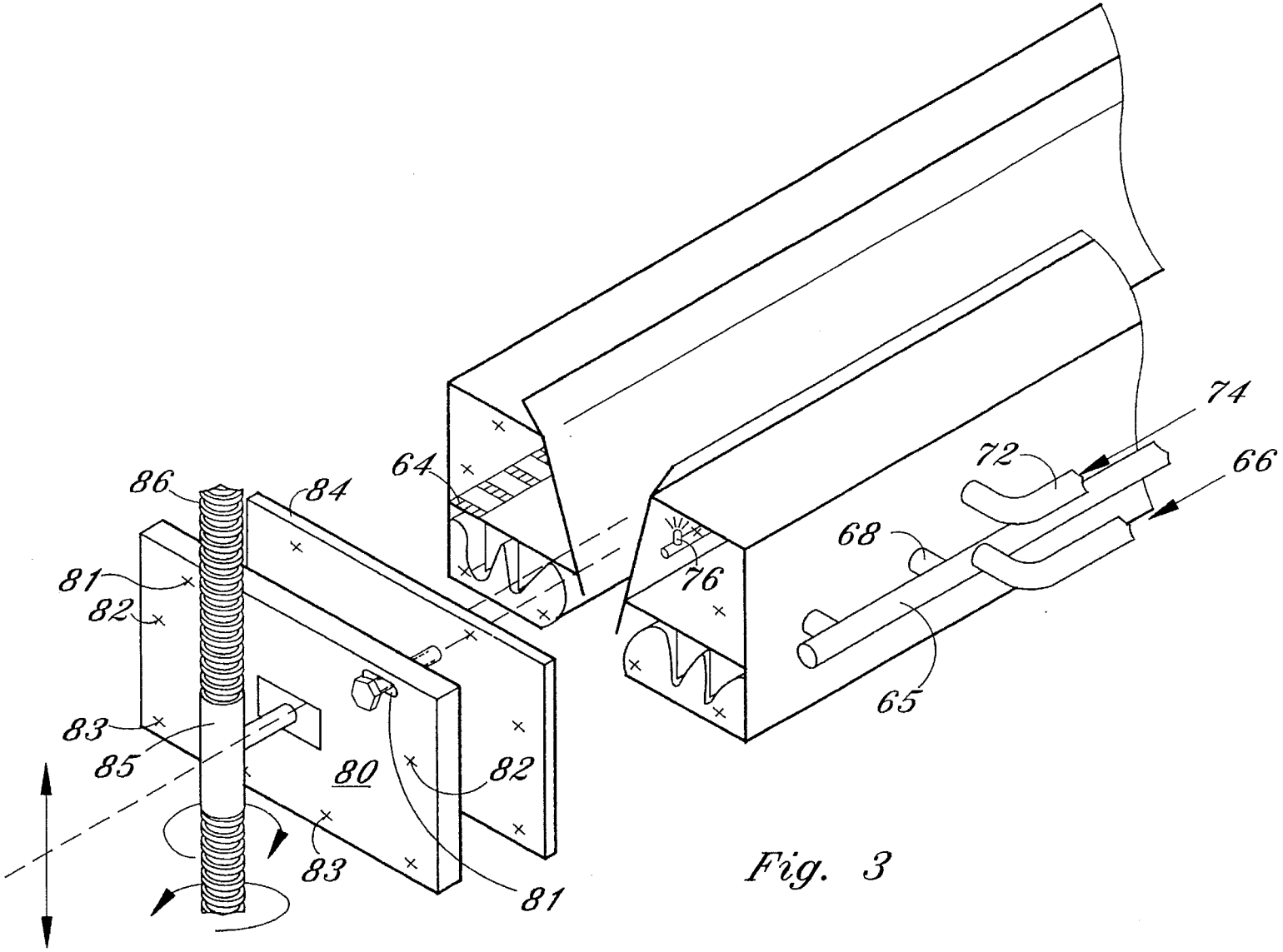
FIG. 3 shows an exploded perspective view showing a drawing unit in accordance with the present invention.

Referring now to FIG. 3, the drawing unit 31 includes on each side the side cover plate 80 connected by a number of bolts 89 through horizontally corresponding extended holes 81, 82, and 83, through which the width of the slots 34 and 44 can be adjusted. A rubber gasket 84 is used between the body of the drawing unit 31 and the side cover plate to seal the unit. The distance between the drawing unit 31 and the web forming table 90 can be adjusted with male screws 86 vertically attached to the side cover plate 80 through matching female screws 85 and driven by a motor with a gear box system 87 attached to the web forming table 90 (see FIG. 1). By turning screws 86, the position of the drawing unit 31 relative to the web forming table 90 can be correspondingly adjusted. FIG. 3 also shows the air supply 66 and water supply conduit 74 attached to input conduits 65, 68, and 72, respectively.

Referring back to FIG. 1, a very important element of the invention is shown. The web forming table 90 is positioned below the slot 32 of the drawing unit 31 to receive filaments F and form the filaments into a non-woven web. The web forming table 90 comprises a vacuum suction box for pulling down filaments onto a moving mesh wire belt conveyor 92 which transports the as-formed web to the next stage of the process for strengthening the web by conventional techniques to produce the final non-woven fabric web. The web forming table 90 includes the adjustable base 93 which is used to adjust vertically the vertical distance between the top of the table 90 and the spinneret 26 in a range of about 30 to 150 cm. The critical distance between the drawing unit 31 (along the top slot 32) and the lower portion or surface of the spinneret 26 is a critical adjustment and critical distance to accomplish the invention. The distance between the bottom of the spinneret and the top of the drawing unit can be adjusted, preferably between 10 to 40 cm during normal production. The following is an example of an apparatus constructed in accordance with the present invention using polypropylene as the polymer.

EXAMPLE

The distance from the top of the drawing unit to the spinneret is about 5 to 70 cm, preferably 10 to 40 cm, during normal production. The width at the top of top slot segment 33 of the drawing unit is about 10 to 20 cm. The width at the top of the upper slot segment 34 is about 5 to 15 cm. The width between opposing edge of slot 32 at shoulder 41 is about 0.3 to 2.0 cm. The gap of the outlet of nozzles 42,43 is about 1.0 to 6.0 mm. The air streams introduced from air supply unit 66 on both sides of the slot have a velocity of about 100 to 350 m/sec at exit of the outlet of nozzles 42,43 and form a turbulent flow as they merge. Air and mist are sucked in from the top open end 33 by the air streams exiting from nozzles 42,43 and this sucked-in stream of air with mist cools and drags filaments along the upper slot segment 34 to nozzles 42,43 where it joins the air stream of turbulent flow. The filaments thus entrained form an intensive "flapping" or "waving" pattern when moving along with the air stream below the nozzle in compliance with the pattern of the air flow. It is this intensive "flapping" motion, coupled with the closeness of the drawing unit to the spinneret, that an ideal situation is created, wherein a significantly increased air drag force produced by "form drag" due to the flapping motion is exerted on filaments that are still "hot" and therefore readily to be stretched, resulting in filaments having a denier of about 0.1 to 2.0 for polypropylene at a production rate of about 250 to 750 kilograms per meter of machine width, hereafter referred to as a dimension corresponding to the width of the spinneret, per hour and 0.3 to 3.0 deniers for polyethylene terephthalate at a production rate of about 350 to 1100 kilograms per meter of machine width per hour.

During startup, filaments are extruded through a spinneret in a form of downwardly vertically advancing curtain at nominal throughout and the drawing unit is positioned way down from the spinneret with nominal air pressure and volume. With this setting, the filament curtain can be cooled down even by ambient air alone to avoid sticking among filaments before being sucked into the drawing unit. When spinline is fully established and stabilized, move the drawing unit up towards spinneret gradually and increase the pressure and volume of the air supply to the drawing unit, at the same time increase the polymer throughput. As the drawing unit moves up closer to the spinneret and higher air pressure and volume is used, the temperature at which the filaments are being drawn and the drag force on the filaments are correspondingly increased, resulting in filaments of smaller size. Reduction in filament size facilitates the cooling of filaments so that the drawing unit can be further moved up toward the spinneret without causing filaments sticking to each other before entering the drawing unit. By repeating those steps of alternatively adjusting the position of the drawing unit, the volume and pressure of the air supply and the throughput of the polymer melt, a desired production can be reached wherein the finest filaments are produced at maximum throughput for the given process condition. While adjusting the processing condition as described above, the position of the web forming table is adjusted accordingly to achieve the best uniformity of the resultant web. The as-formed web can then be subject to one of many conventional techniques for bonding or tangling to form the final spunbond fabric web, or wound up as it is without any further process, depending upon the end uses of the web.

The preferred embodiment includes the drawing unit which can be raised up to a close distance of about to 5 to 70 cm from the spinneret during normal production, in that filaments of 0.1 to 2.0 deniers for polypropylene at a production rate of 250 to 750 kilograms per meter of machine width per hour and 0.3 to 3.0 deniers for polyethylene terephthalate at a production rate of 350 to 1100 kilograms per meter of machine width per hour can be produced. The preferred embodiment further includes a web forming table which is capable of adjusting its position both horizontally and vertically in accordance with positions of the spinneret and the drawing unit to achieve a uniform non-woven web which may then be bonded by one of many known techniques to produce the final spunbond fabric webs.

Thus, it is apparent that the present invention has provided an apparatus and a process for producing spunbond non-woven webs that fully satisfies the objects, aims, and advantages set forth above.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A process for forming a spunbound, non-woven polymeric fabric from a plurality of polymeric extruded filaments, comprising the steps of:

(a) extruding a plurality of vertically oriented filaments by melt spinning through a spinneret from a thermoplastic polymer;

(b) drawing said filaments by a drawing means positioned below said spinneret using air pressure, applying said drawing means a predetermined distance away from said spinneret; and (c) forming a spunbound, non-woven polymeric fabric on a web forming means, said drawing means positioned less than 50 centimeters below said spinneret, whereby the diametric size of each of the filaments can be controlled by the distance of the drawing means from the spinneret.

2. A process as described in claim 1, including the step of adjusting the distance separating the spinneret and the drawing means to between 5 centimeters and less than 50 centimeters.

3. A process for forming a spunbound, non-woven polymeric fabric from a plurality of polymeric extruded filaments, comprising the steps of:

(a) positioning a filament drawing means at startup away from a spinneret from three to five meters from the spinneret at startup;

(b) extruding a plurality of vertically oriented filaments by melt spinning through said spinneret from a thermal plastic polymer;

(c) drawing said filaments by a drawing means positioned below said spinneret using air pressure;

(d) stabilizing the spin line;

(e) gradually reducing the distance separating the drawing means and the spinneret to between 5 centimeters and less than 50 centimeters; and (f) forming a non-woven polymeric fabric from said filaments on a web forming means.

* * * * *